US006188185B1

(12) United States Patent
Ter-Hovhannisian et al.

(10) Patent No.: US 6,188,185 B1
(45) Date of Patent: Feb. 13, 2001

(54) PROCESS FOR MANUFACTURING A NEON TUBE, AND RELATED LOW TEMPERATURE LIGHTING SYSTEM

(76) Inventors: Artak Ter-Hovhannisian; Zorak Ter-Oganesian, both of 606 E. Santa Anita Ave., Apt. D, Burbank, CA (US) 91501

( * ) Notice: Under 35 U.S.C. 154(b), the term of this patent shall be extended for 0 days.

(21) Appl. No.: 09/491,182

(22) Filed: Jan. 25, 2000

Related U.S. Application Data

(60) Provisional application No. 60/117,112, filed on Jan. 25, 1999.

(51) Int. Cl.[7] ..... H05B 37/00

(52) U.S. Cl. ..... 315/312; 315/118; 315/282; 362/92; 362/158; 362/223; 362/227

(58) Field of Search ..... 315/112, 118, 315/143, 276, 282, 312, 358; 362/92, 125, 126, 133, 158, 224, 227, 223, 296, 329

(56) References Cited

U.S. PATENT DOCUMENTS

| | | | | |
|---|---|---|---|---|
| 4,940,921 | * | 7/1990 | Helling et al. | 315/219 |
| 5,471,372 | * | 11/1995 | Mamelson et al. | 362/92 |
| 5,879,070 | * | 3/1999 | Severloh | 362/125 |
| 5,893,627 | * | 4/1999 | Tague | 362/133 |
| 5,895,111 | * | 4/1999 | Santosuosso et al. | 362/125 |
| 5,937,666 | * | 8/1999 | Trulaske, Sr. | 62/264 |

* cited by examiner

*Primary Examiner*—Haissa Philogene
(74) *Attorney, Agent, or Firm*—Kelly Bauersfeld Lowry & Kelley, LLP

(57) ABSTRACT

A lighting system is provided which is utilized in lower temperature environments, such as refrigeration units and the like which uses specially constructed neon tubes to reduce the size of the lighting system while emitting sufficient white light to adequately light the refrigeration unit. The process of manufacturing the neon tube includes attaching electrodes to open ends of a glass tube having in interior phosphate coating. Current is applied until the glass tube is raised to a predetermined temperature, and the contents of the tube are evacuated. Cleaning gas is injected into the glass tube and the glass tube is again evacuated. The glass tube is then filled with mercury and a neon and argon gas mixture and sealed. The resulting white light-emitting neon tubes, which have a diameter of six to eight millimeters, are positioned within an elongated cavity of a frame of the lighting system. The neon tubes are positioned substantially parallel to one another within the central cavity such that each has a different angle of orientation relative to a longitudinal axis of the frame. Two opposite ends of the frame are hermetically sealed with caps having connectors which allow electrical connection between the neon tube and a power supply. In a first embodiment of the present invention, the frame is removably mounted coplanar, or horizontal, to a refrigeration unit shelf. In a second embodiment, the frame is positioned a predetermined distance from and perpendicular to a refrigeration unit shelf by mounting the frame to a refrigeration unit mullion.

22 Claims, 7 Drawing Sheets

PROCESS FOR MANUFACTURING A NEON TUBE, AND RELATED LOW TEMPERATURE LIGHTING SYSTEM

RELATED APPLICATION

This application claims priority from provisional application Ser. No. 60/117,112 filed Jan. 25, 1999.

BACKGROUND OF THE INVENTION

This invention relates to lighting systems. More particularly, the present invention relates to a neon tube lighting system which operates in a reduced temperature environment, such as in a refrigerator or freezer unit.

In the grocery store, frozen foods such as juices, ice cream and vegetables, as well as those which need to be maintained at lowered temperatures such as diary products and fresh meat, must be stored in refrigeration units. The refrigeration units which contain these products must be properly lit as the associated shelving and doors create shadows or otherwise block outside ambient light from entering the refrigeration unit.

Flourescent lights have been used in such applications because the flourescent tubes are brighter and generate less heat than incandescent bulbs. However, use of flourescent lights has many drawbacks. Flourescent lights have filaments at each end which output a frequency and generate heat when an appropriate amount of current and voltage applied. The heated filaments warm a mixture of xenon, argon and krypton gas within the flourescent tube causing it to fire and generate light. It is difficult to fire and continue to keep flourescent tubes lit in low temperature environment applications as the mixture of gas must reach and maintain a certain elevated temperature to fire and remain lit. The cold environment acts to lower the temperature of the flourescent bulb, and thus the gas mixture within the bulb. In fact, flourescent tubes cannot be started in sub-zero temperatures and are very inefficient in colder temperatures above zero. Higher frequencies have been applied to the flourescent tubes to cause the gas mixture to continually generate light, however the high frequency causes electromagnetic interference (EMI) which is costly to filter. Unfiltered EMI caused by the generated high frequencies can cause nearby electronic devices to malfunction or even fail. The flourescent tube filaments are easily broken by vibration and from extreme variations from hot to cold, resulting in a shorter operational life span of the flourescent tubes. In order to partially resolve the problem of operating flourescent bulbs in a cold environment, a surrounding lense and insulator has been disposed around the flourescent tubes' filaments to at least partially retain the heat generated by the flourescent tube filaments.

Flourescent tubes present additional problems when used in cold environment applications. The filaments of the flourescent tubes are easily burnt or broken, and the thin-walled glass used in the flourescent tubes is susceptible to breakage. Flourescent tubes have rated operational lives of only 1,500 to 5,000 hours. Thus, the tubes must frequently be replaced. In fact, it is customary for retailers such as grocery stores to have maintenance contracts wherein all of the flourescent tubes in the refrigeration units are replaced on a schedule well before the rated operational lives of the flourescent tubes so that the service company is not constantly called to replace individual flourescent tubes which have burnt out. Such maintenance increases the cost of operating the refrigeration units.

Ballasts are used in flourescent lighting systems to convert the supplied alternating current to the desired frequency.

These ballasts are usually quite large and in their smallest form are fitted into the mullion, or dividing frame, of the refrigeration unit's doors. As either 110V to 240V of alternating current is used to power the flourescent systems, the design of the systems must be approved for safety. Such approval can be time consuming and costly.

Due to the size of the ballasts, the size of the flourescent tubes they are necessarily positioned vertically along the mullion of the doors or frame of erect or free standing refrigeration units. This positioning, as well as the inherent limits of the flourescent tubes light output, creates an uneven lighting across the shelves of the display. For example, the shelving closest to the flourescent tubes has as much as three hundred percent more light than that portion of the shelving in the middle of the door which is between the vertical flourescent tube banks. Due to the size of the flourescent tube banks, the shelving must be a considerable distance from the doors so that the light from the flourescent tube banks is not shielded by posts of the shelving and product closest to the lights.

In open-display refrigeration units, the shelving must necessarily be stepped and staggered with shelves of less width on top and shelves of greater width on the bottom so as not to shield the lower shelving from the flourescent tubes which are positioned along the top of the unit. Usually, only one bank of flourescent tubes is used along the top of the refrigeration unit since placing flourescent tube banks on each shelf would occupy too much shelf space and pose safety concerns.

Another problem associated with the use of flourescent tubes is that the flourescent tubes are produced in pre-set lengths of four, five, six and eight feet. The designers of refrigeration units must conform their units to these lengths or heights so that the product within the units is adequately lit. This results in ineffective use of the corners and other odd-sized areas of the store, reducing the amount of shelf space available to store and display goods. Shelf space is tantamount not only to the grocery store, but also the suppliers as an increase in only a few inches of shelf space can translate into much more product being displayed and eventually sold. Limiting the shelf space results in lost profits.

Still another problem associated with flourescent tubes is that their thin walls can easily be broken or shattered. The mercury within the flourescent tubes is a health concern. Also, the broken shards of glass is potentially dangerous to consumers within the retail establishment.

Accordingly, there is a need for an improved lighting system which operates efficiently in low temperature environments such as refrigeration units and the like. What is also needed is a low temperature lighting system which has a longer operational life and reduced maintenance costs in comparison with prior systems. Additionally, a low temperature lighting system is needed which occupies less space and more evenly distributes light across the refrigeration unit. Such a system should optimally be flexible in length or height to accommodate the individual needs of the store. Moreover, a low temperature lighting system is needed which is capable of being placed horizontally on a shelf of the refrigeration unit without concern of space constraints or electrocution. The present invention fulfills these needs and provides other related advantages.

SUMMARY OF THE INVENTION

The present invention resides in a lighting system utilized in lower temperature environments, such as refrigeration units and the like. Specially constructed neon tubes are used in order to reduce the size of the lighting system while emitting sufficient white light to adequately light the refrigeration unit.

In manufacturing the neon tube, a glass tube is internally coated with a tri-phosphor blend. A first electrode having an air passageway is attached to a first end of the glass tube by glass welding or the like, and a second electrode is likewise attached to a second end of the glass tube. The air in the glass tube is then pressurized to a level of three to four Torr. A nominal current is applied to the electrodes and the current level is increased to at least 50 milliamps to raise the glass tube temperature to at least 150° C. The air pressure within the glass tube is then decreased to one and one-half Torr and the current is increased to 250 milliamps until the glass tube reaches a predetermined temperature of approximately 275° C. The current is removed and the glass tube is evacuated until the temperature of the glass tube is reduced to approximately 60° C. A nominal current is applied while a cleaning gas is injected into the glass tube. The cleaning gas is injected and the nominal current applied for a maximum of two minutes at four Torr. The current is again removed and the glass tube evacuated until the temperature of the glass tube is again reduced to approximately 60° C. The glass tube is then filled with mercury and a gas mixture comprising 85%–95% neon and 5%–15% argon to a pressure of between fifteen and sixteen Torr. The first end of the glass tube is sealed off to completely seal the neon tube.

The resulting white light-emitting neon tube, which has a diameter of six to eight millimeters, is positioned within a frame of the lighting system. More particularly, the neon tube is placed within an elongated central cavity of the frame adjacent to a reflective coating which faces a transparent portion of the frame. The frame is hermetically sealed by attaching caps at each end thereof. The caps have connectors which allow electrical connection between the neon tube and a power supply. Preferably, multiple neon tubes are positioned substantially parallel to one another within the central cavity such that each has a different angle of orientation relative to a longitudinal axis of the frame. The frame also preferably includes an internal clip to which the neon tubes are securely attached.

The caps which seal the ends of the frame include electrical connectors incorporated therein which are capable of mating with cap electrical connectors of a second or more frames in order to electrically interconnect multiple frames.

The power supply converts 110 to 240 volts of alternating current to 12 to 24 volts direct current. A transformer is electrically interconnected between the power supply and the neon tube and converts the 12–24 volts direct current to a high voltage of at least 800volts for lighting the neon tube. The transformer is typically positioned within the central cavity of the frame.

In one embodiment of the invention, the frame is removably mounted horizontally with a refrigeration unit shelf using brackets attached to the frame. Alternatively, each cap includes a protuberance which extends form the end of the cap and is configured to slidably fit within a channel of a track positioned perpendicular to the frame. The protuberance includes electrodes which contact electrodes within the track when the protuberance is fitted within the track in order to supply power to the neon tube of the system.

In another embodiment, the frame is positioned a predetermined distance from and perpendicular to a refrigeration unit shelf by mounting the frame to a refrigeration unit mullion which contains the power supply.

In both embodiments, valuable space is conserved using the compact lighting system of the invention. Use of the neon tubes and power supply also conserves energy and reduces the maintenance costs associated with lighting the refrigeration units. Furthermore, the white light-emitting neon tubes provide more light than conventional flourescent systems and the configuration of the frame distributes the light more evenly across the refrigeration unit shelves.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
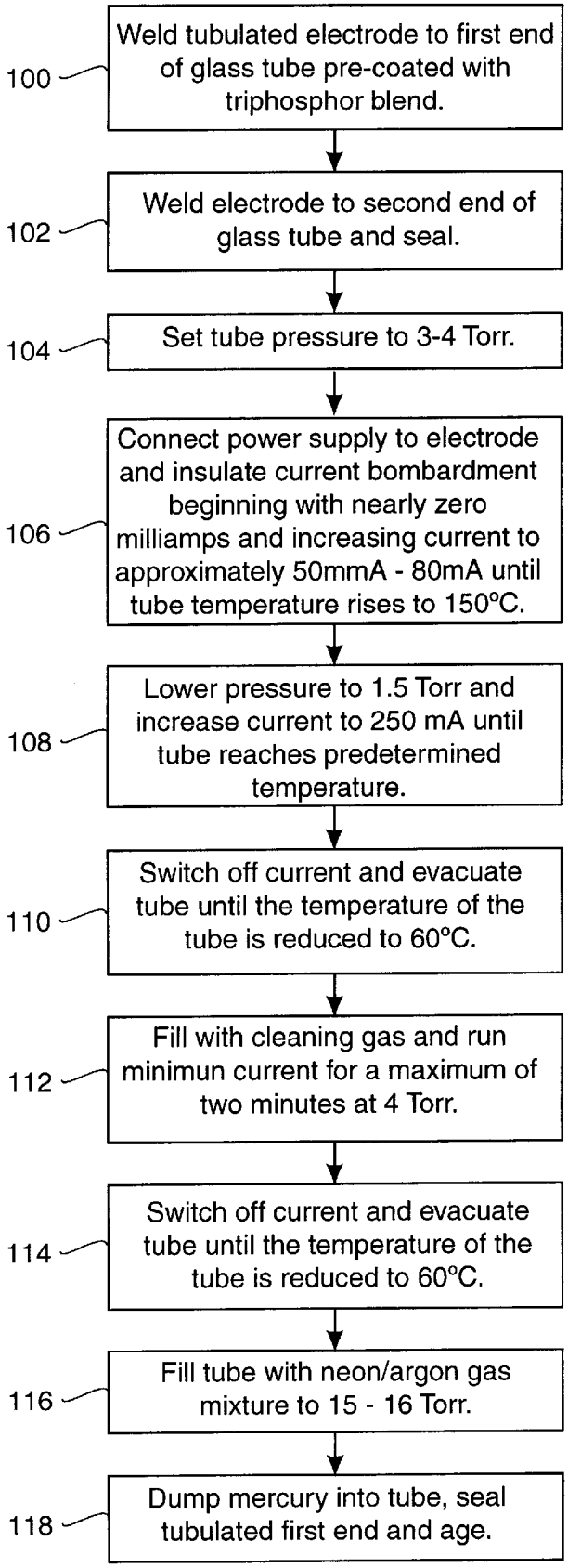
FIG. 1 is a flow chart illustrating the steps in the process of forming a neon tube used in the lighting system of the present invention.

As shown in the drawings for purposes of illustration, the present invention is concerned with a process for manufacturing a neon tube 10, and the application of the neon tube 10 to a lighting system (generally referred to in FIGS. 2–5 by the reference number 12, and in FIGS. 6–7 by the reference number 14, and in FIGS. 8 and 9 by the reference number 16) used in low temperature environments, such as a refrigerator unit 18 or the like. It should be noted that the term "neon tube" within this description refers to both cold cathode tubes as well as neon tubes.

Neon tubes 10 are not commonly used as a primary light source, but rather are used traditionally in varying colors and shapes as decorative lighting. This is particularly the case when the light source must be placed in a low temperature environment as neon tubes 10 are more expensive than flourescent bulbs and have traditionally suffered many of the same setbacks as flourescent bulbs when utilized in lower temperatures. Traditional neon tubes are rather large in diameter and tend to spot and blacken over time in refrigeration units. The neon tubes 10 utilized in the systems 12–16 are specially constructed so as to overcome these deficiencies.

The process for manufacturing the neon tubes 10 is generally illustrated in FIG. 1. First, a tubulated electrode is attached by glass welding to a first end of a glass tube which has been coated with a tri-phosphor blend (100). Glass tubes can be acquired which have been pre-coated with a layer of three different types of phosphorous. Attaching electrodes by glass welding is well known in the art and generally comprises heating an end of the glass tube until it is red hot while blowing air through the glass tube to prevent distortion of the glass tube. The hot end of the tube is pushed onto the electrode and then pulled away to prevent excessive pressure strains on the glass. After the first electrode is attached, air is pumped through the glass tube through the tubulated electrode as a second electrode is attached to the opposite end of the glass tube in the same manner described above, effectively sealing the second end of the glass tube (102).

If the electrode in the glass tube does not include a mercury vial, a mercury trap is welded onto the glass tube's tubulated first end. The mercury trap essentially comprises a hollow tube having a glass sphere between the ends thereof and partially filled with mercury. Due to its weight, the mercury remains in the sphere during the process until it is intentionally added to the glass tube, as is well known in the art.

The process described to this point is fairly standard in the industry and is typically followed by a current bombardment which vaporizes impurities before evacuating the glass tube with a vacuum or negative pressure and then filling the glass tube with the desired gas. However, the glass tubes used in the present invention are only six to eight millimeters in diameter as opposed to the standard twelve to fifteen millimeter tubes used in decorative neon lights and must be treated more carefully or the phosphorous wall will be damaged. It has also been found that the traditional process leaves impurities which cause the neon tube 10 to darken and prematurely lose its effectiveness. Therefore, the following additional construction steps are implemented to create a thin neon tube 10 which is very bright and which retains approximately the same useful life (700,000 to 1,000,000 hours) as a traditional neon tube.

Through the tubulated end, the air pressure of the glass tube is set from two to three Torr (104). A power supply is connected to the electrodes and nearly zero milliamps of current is initially applied and eventually increased to approximately 50 to 80 milliamps until the temperature of the glass tube rises to approximately 150° C. (106). The air pressure is then lowered to approximately one and one-half Torr, and the current applied is increased to a level of 250 milliamps until the glass tube reaches a predetermined temperature (108). The predetermined temperature is typically approximately 275° C. and can be either measured with a thermometer or visually gauged when the electrodes turn an orangish-red color. To determine the temperature more accurately, a colored marker is placed on the glass tube and when the glass tube reaches the predetermined temperature, the colored dot marker turns gray.

To remove the residue of the impurities, the current is switched off and the glass tube is evacuated until the glass tube temperature is reduced to approximately 60° C. (110). The glass tube is then filled with a cleaning gas (90% helium and 10% neon) and a small amount of current is applied at four Torr for a maximum of two minutes (112). The minimal current acts to excite the cleaning gas and dislodge and attract additional impurities to the cleaning gas. However, application of the excited cleaning gas for too long can cause damage. The glass tube has risen in temperature due to the current and pressure, thus the current is switched off again and the glass tube evacuated until the temperature of the tube is reduced to 60° C. (114) to remove the residue of the impurities attracted during the cleaning step (112).

The glass tube is then pressure filled with a neon and argon gas to a level of fifteen to sixteen Torr (116), typically twenty-one millibar. The gas mixture is preferably 93% neon and 7% argon, although slight variations of a few percentages are acceptable. The mercury is tapped in or otherwise added and the tubulated end of the glass tube is sealed and the neon tube 10 aged (118). The neon tube 10 is aged by connecting a power supply to the electrodes and applying power to the neon tube 10 for several minutes to vaporize the mercury and excite the gas contents of the neon tube 10 until white light is emitted.

Figure 2:
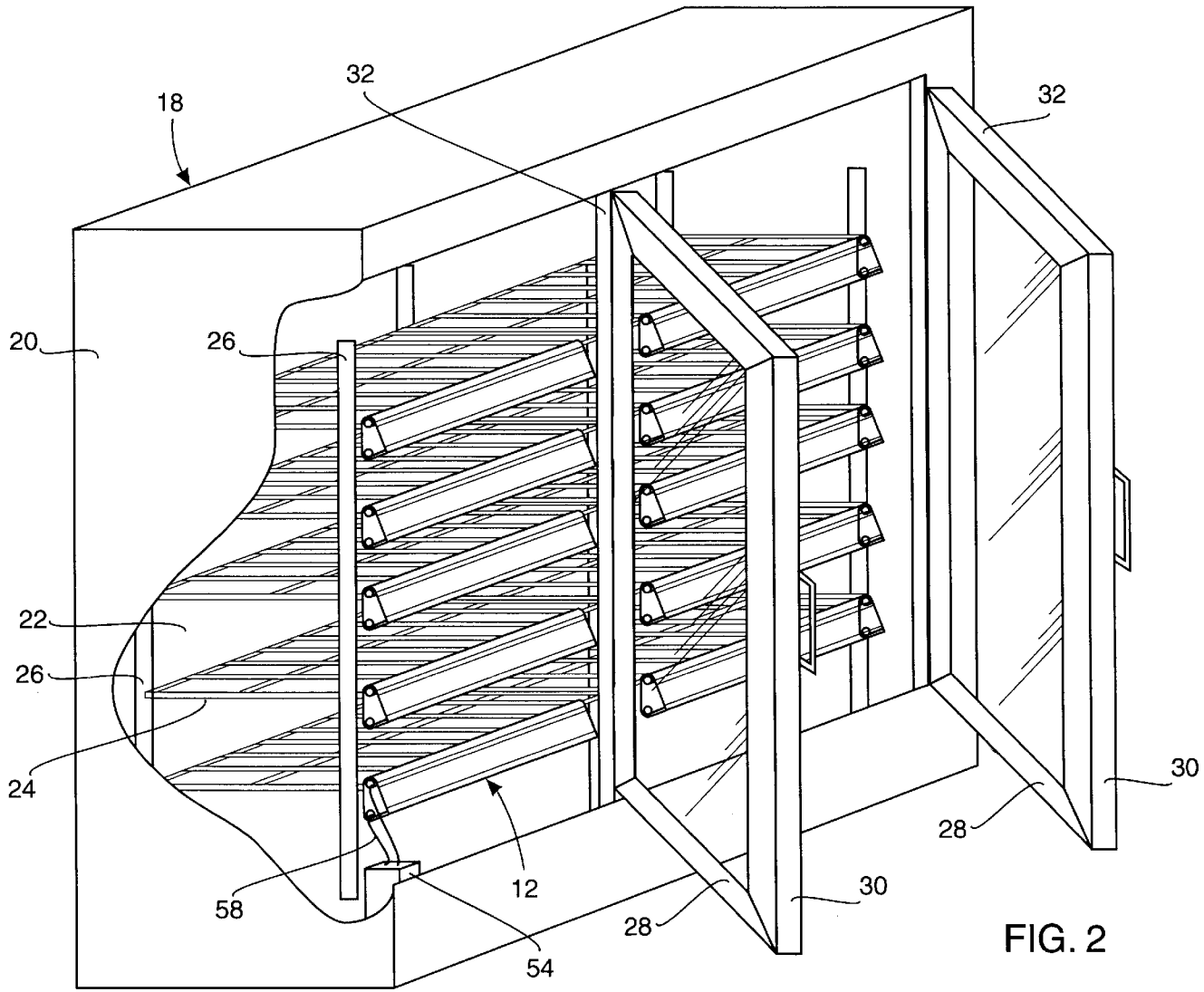
FIG. 2 is a perspective view of a refrigeration unit having lighting system devices of the present invention horizontally attached to shelves.

In accordance with the invention, the neon tube 10 is incorporated into a lighting system 12 for use in a refrigeration unit 18. A standard refrigeration unit 18 is illustrated in FIG. 2 and includes an insulated outer casing 20 which defines a hollow interior 22. Shelves 24 are typically adjustably arranged on posts 26 or the like and spaced a predetermined distance apart from one another. Insulated or double paned glass 28 paneled doors 30 are hingedly connected to the outer casing 20. Most refrigeration units 18 include mullion 32 between the doors 30 from which the doors 30 hinge.

The mullion 32 used in current refrigeration units 18 must be large enough to accommodate the ballast of the flourescent tube systems. The shelves 24 and posts 26 are set back within the interior 22 to accommodate the placement of the vertical flourescent systems with additional space provided so as not to shield the flourescent tubes. Some presently used flourescent systems are placed at the top of the interior 22, requiring the topmost shelf 24 to moved downwardly. As will be seen from the following description, the lighting systems 12–16 of the present invention require much less space than existing flourescent systems and are capable of horizontal placement directly on the shelves 24.

Figure 3:
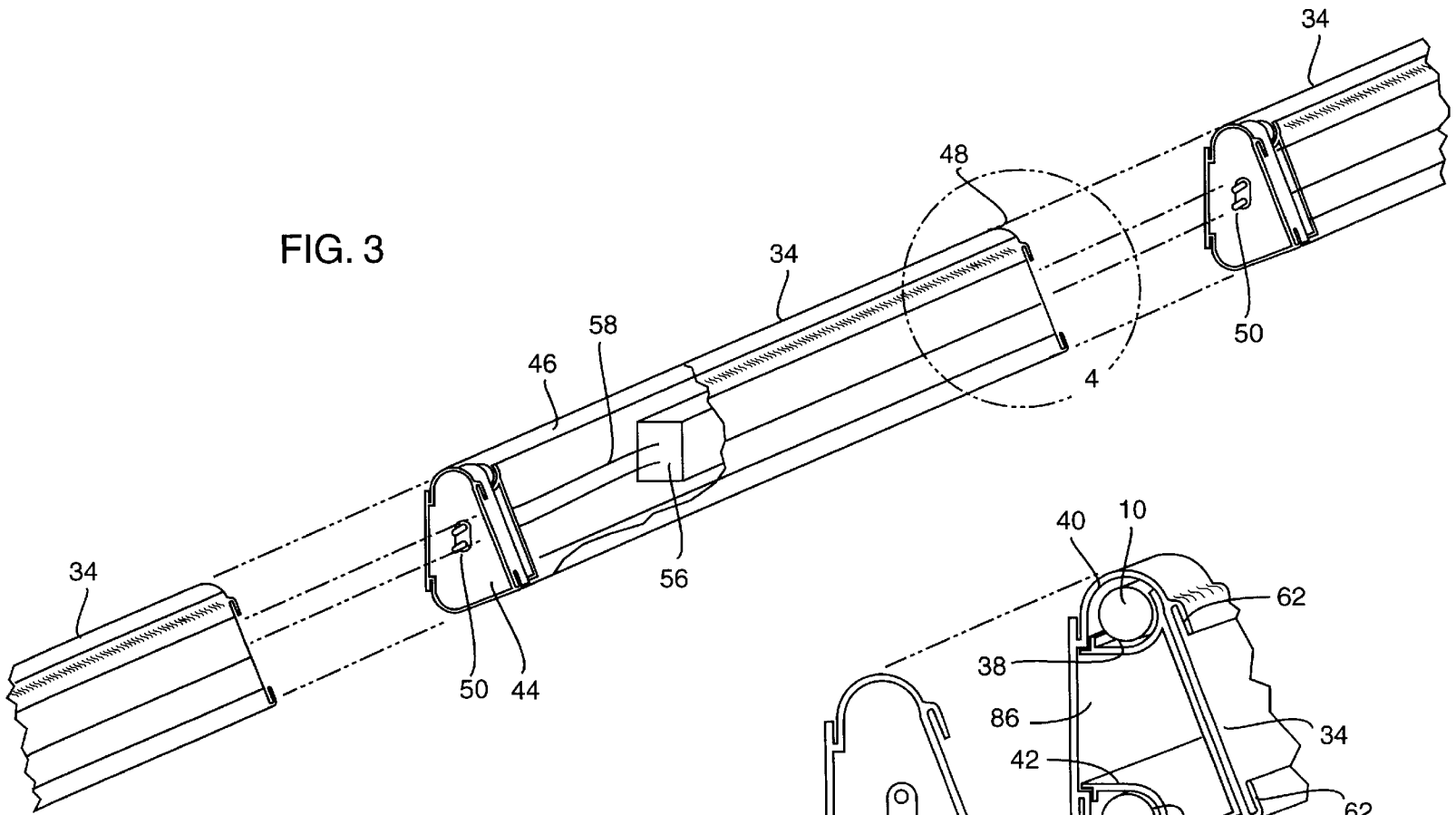
FIG. 3 is partially fragmented and exploded view of three lighting system devices of the present invention which are electrically interconnected to one another by way of connectors within endcaps.
Figure 4:
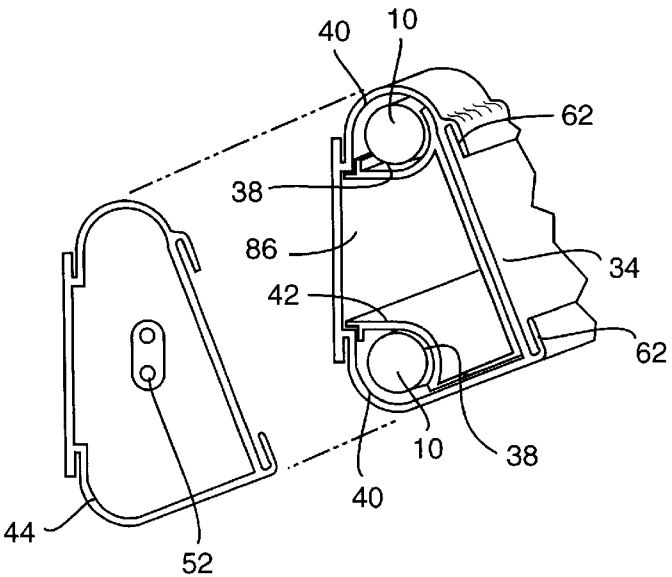
FIG. 4 is a partially fragmented and exploded view of a lighting system device of FIG. 3, illustrating the endcap and neon tubes within a frame of the lighting system device.
Figure 5:
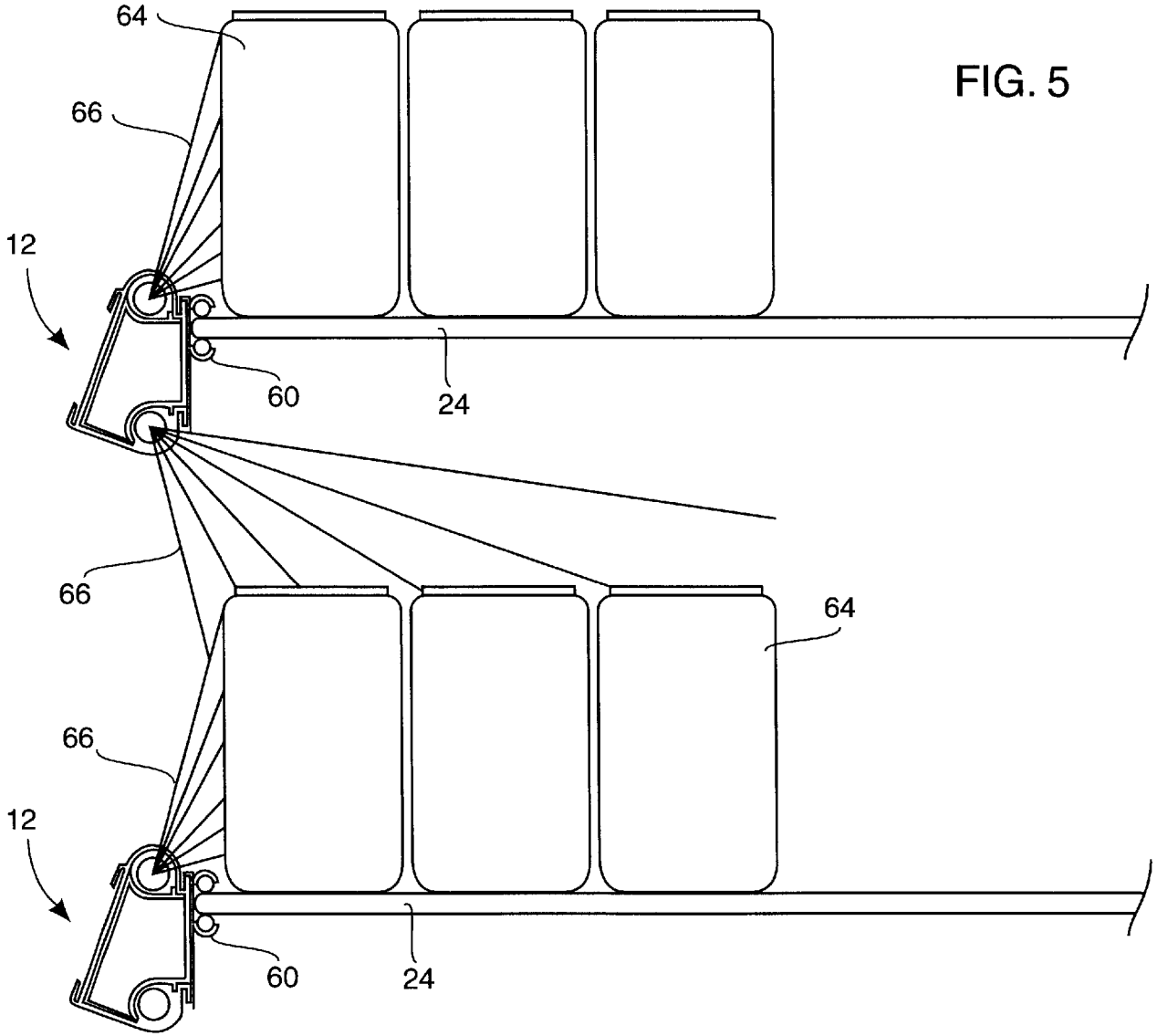
FIG. 5 is a cross-sectional view of two lighting system devices clipped onto refrigeration unit shelves bearing product.

Referring to FIGS. 3–5, the system 12 includes a frame 34 which forms a central elongated cavity 36 into which the neon tubes 10 are positioned. A portion of the frame 34 adjacent to the neon tubes 10 is coated with a reflective material 38. Facing opposite the reflective material 38 lies a transparent portion 40 of the frame 34, typically constructed of a durable clear plastic such as poly carbonate. Preferably, the frame 34 forms or otherwise includes a clip 42 to hold each neon tube 10 securely in place. A cap 44 is connected to each end 46 and 48 of the frame 34 so as to hermetically seal the contents of the frame 34 from moisture and cold air. The hermetic seal of the frame 34 also acts to fully contain the mercury and glass fragments on the rare occasion that a neon tube 10 breaks. The polycarbonate composition of the glass tube grants quite a bit of flexibility to the neon tube 10, so breakage is rare.

The caps 44 illustrated in FIGS. 2–5 include either a male connector 50 or a female connector 52 which are interconnectable so that a first frame 34 can be attached to a second or even third frame 34, as illustrated in FIG. 3. The connectors 50 and 52 also act to provide power from an external power supply 54 to the neon tubes 10. If the frames 34 are not interconnected, wires which have electrical connectors which mate with the end cap connectors 50 and 52 interconnect each of the frames 34 to the power supply 54.

In the embodiment illustrated of FIGS. 2–5, a transformer 56 positioned within the central cavity 36 of the frame 34 is interconnected between the cap connectors 50 and 52 with wires 58 and the neon tube 10. The power supply 54 converts wall provided 110–240 AC voltage to 12–24 volts direct current and the transformer 56 converts this low direct current voltage to at 800 volts, and preferably one to five kilovolts, to light the neon tubes 10. The increase in voltage occurs entirely within the sealed frame 34. The conversion of the wall alternating current voltage to a lower direct current voltage practically eliminates any concern for electrocution from the exposed wires 58 leading from the power supply 54 to the lighting system devices 12.

Referring now specifically to FIG. 5, horizontal shelf lighting has been virtually non-existent due to the size and weight constraints of providing such lighting with flourescent bulbs and ballasts. However, the lightweight and compact lighting system devices 12 of the present invention are mountable directly to a shelf 24 of the refrigeration unit 18 by means of a bracket 60 attached to the frame 34 so that the lighting system device 12 lies coplanar, or horizontal, to the shelf 24. Guides 62 are also attached to the frame 34 on the surface opposite the shelf 24 and facing the customer for the placement of price tags and the like. The preferably two neon tubes 10 are positioned within the frame 34 so as to be generally parallel to one another. However, the neon tubes 10 are angled so that one neon tube 10 illuminates product 64 with its generated light 66 on top of the shelf 24 to which the lighting system 12 is attached, while the other neon tube 10 illuminates the product 64 on the shelf 24 below the system 12 in order to fully and evenly illuminate the product 64. The small diameter, preferably only six millimeters, neon tubes 10 and the small transformer 56 allow the system devices 12 to be small and lightweight. In contrast, presently used refrigeration lighting systems comprise vertically mounted flourescent tubes which results in as much as three times the light being cast on the product 64 closest to the flourescent lights as that cast upon the product 64 in between the lights. Another advantage of the horizontal lighting system 12 of the present invention is the acquisition of several inches of space and storage capacity that was once occupied by the large vertical flourescent lights as the presently used flourescent systems occupy approximately four inches of space as compared to the less than two inches of the invention.

Figures 6, 7:
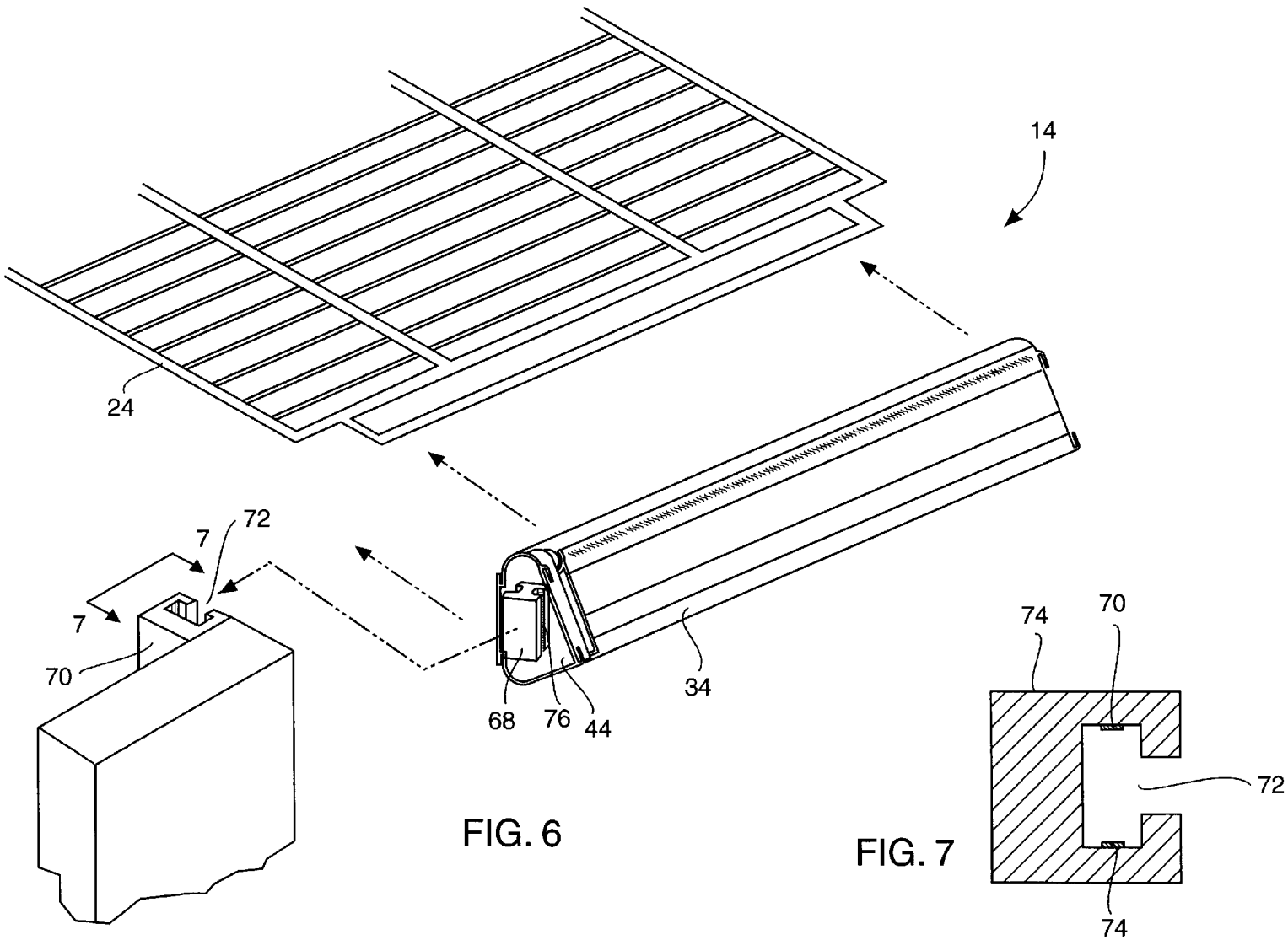
FIG. 6 is a partially fragmented and exploded view of a lighting system device removably attachable to a shelf and having a protuberance extending from the endcap and insertable into a track.
FIG. 7 is an enlarged cross-sectional view taken along line 7—7 of FIG. 6, illustrating electrodes positioned within the track for supplying power to the lighting system device.

Another horizontal lighting system 14 is illustrated in FIGS. 6 and 7, wherein a protuberance 68 extends outwardly from each of the caps 44. The protuberance 68 is configured to slidingly fit within a track 70 positioned perpendicular to the shelves 24 of the refrigeration unit 18. Typically, the track 70 is attached to the mullion 32 of the refrigeration unit 18. Preferably, the track 70 is configured to have a T-shaped cavity 72 into which the mating T-shaped protuberance 68 is inserted into the top of the track 70, but cannot be pulled out along the length of the track 70. The track 70 includes electrodes 74 which carry the 12–24 VDC from the power supply 54 at all times. The protuberances 68 also include electrodes 76 which are positioned to contact the track electrodes 74 when the protuberance 68 is inserted into the track 70 in order to transmit the power to the transformer 56 and the neon tubes 10 of the lighting system device 14.

In use, the protuberances 68 of the lighting system device 14 are inserted into the T-shaped cavity 72 of the track 70 and are frictionally pushed downwardly until the lighting system device 14 is parallel and coplanar with the desired shelf 24. The shelf 24 is preferably modified to have an extending wire 78 or the like to which an extending bracket 60 or the like from the frame 34 of the lighting system device 14 can be hooked to. Hooking the system 14 to the shelf 24 stabilizes and supports the position of the system 14 and also reinforces the system 14 against damage which might occur if the system 14 were pulled away from the shelf 24 and towards the consumer. Although this embodiment is capable of being used with nearly all horizontal shelves 24, it is particularly adapted for use in refrigerators 18 which house wheeled shelving, such as the dairy case. Once the product 64, such as milk, is exhausted the wheeled shelving is removed and replaced with another wheeled shelving filled with product 64. Use of the track system 14 allows the user to unclip the system devices 14 from the shelves 24 and re-position and re-clip the system devices 14 to the filled shelves 24.

Figure 8:
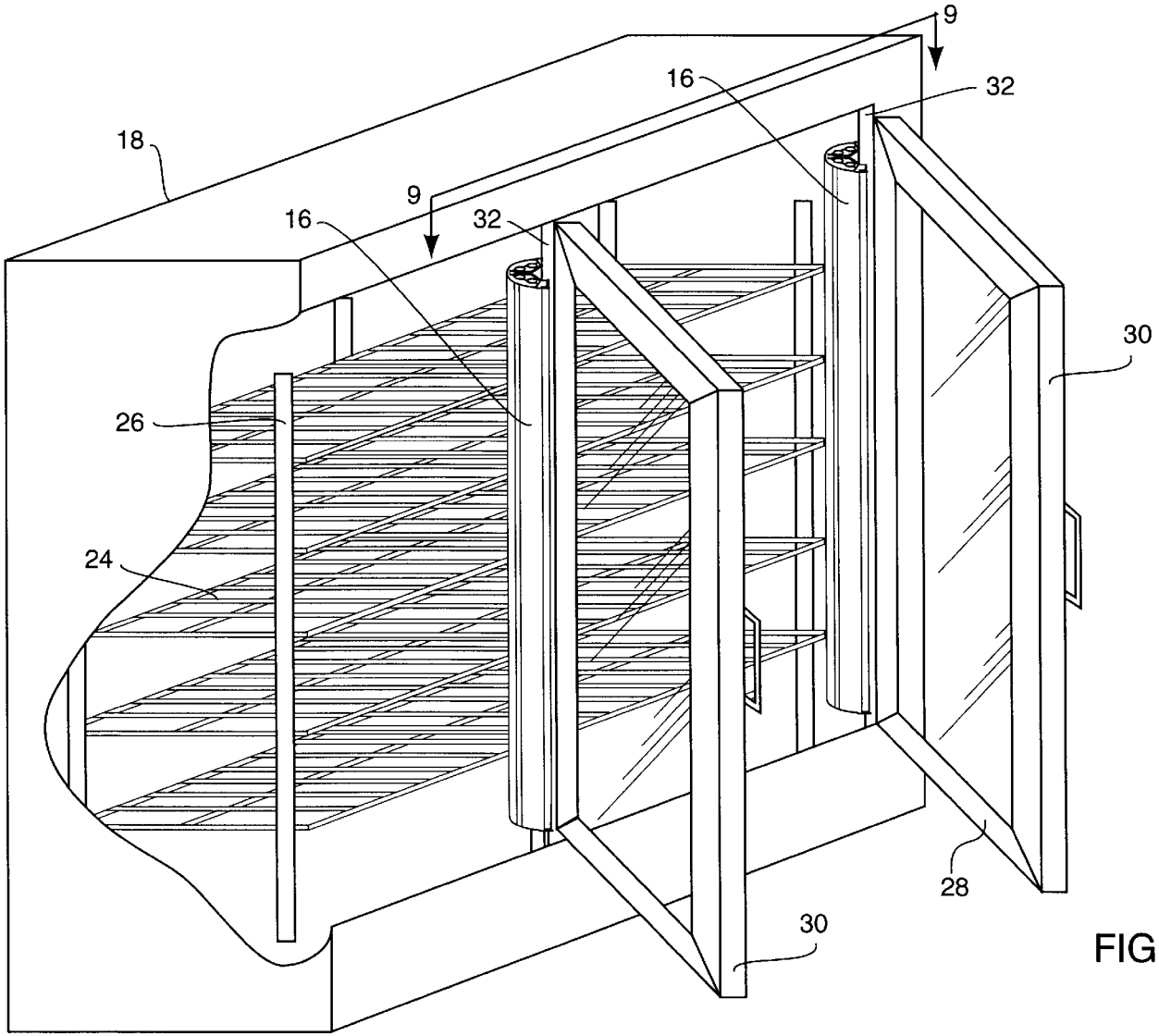
FIG. 8 is a perspective view of a refrigeration unit having another form of the lighting system devices positioned vertically.
Figure 9:
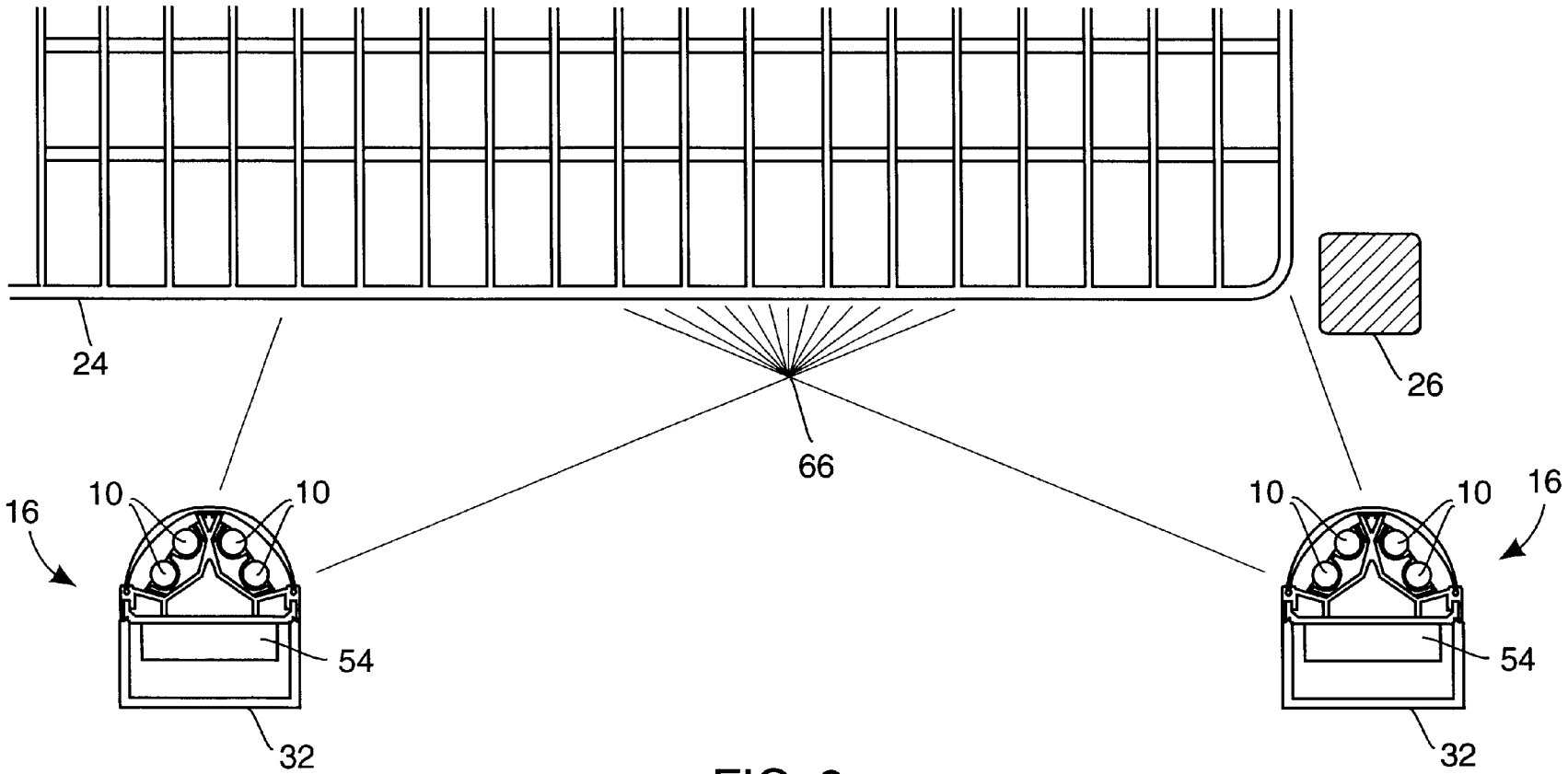
FIG. 9 is a top and partially cross-sectional view taken generally along line 9—9 of FIG. 8, wherein the lighting system devices are mounted on door mullions of the refrigeration unit, and oriented vertically to the shelves of the refrigeration unit.

A third embodiment of the present invention is illustrated in FIGS. 8 and 9, wherein the lighting system 16 is positioned vertically along the mullion 32 of the refrigeration unit. As the lighting system device 16 is positioned on the mullion 32, the power supply 54 can be installed into the mullion 32 and supply the neon tubes 10 with sufficient voltage to light the neon tubes 10 without the need for a transformer 56 and without concern of electrocution to the customer as there are no exposed leads which the customer may contact. Of course, the system 16 can also utilize the transformer 56 as described above.

As illustrated in FIG. 9, the frame 34 preferably contains four neon tubes 10 positioned and angled so as to more evenly distribute light across the entire length of the shelf 24. Existing systems can be retrofitted quite easily by removing the flourescent systems and ballasts within the mullion 32 and replacing these systems with the system 16 of the present invention. As the lighting system devices 16 are only one and one-half to two inches in diameter, several inches of storage space are gained, allowing existing refrigeration units 18 to be retrofitted with deeper shelves 24. A few inches of storage space along the length of the refrigeration unit 18 can translate into an overall gain of several cubic feet, allowing the retailer and supplier to stock more product 52 and realize additional revenues.

Even more important than the retrofitting of existing refrigeration units 18 to gain more storage space, the neon tubes 10 of the present invention can be constructed of varying lengths to accommodate the specific needs of retailers. Instead of being limited to the pre-set sizes of flourescent bulbs, the retailer can custom design its refrigeration units 18 to fit the specific needs of the retailer. For example, the length of corners within the retail establishment can be maximized using the present invention, as can odd-sized walls. Moreover, retailers will not be limited to staggered shelving presently used, but can extend all shelves 24 to the same length without the inadequate lighting dilemmas now experienced.

Another advantage of using the present systems 12–16 is that the neon tubes 10 have a life expectancy of approximately 700,000 to 1 million hours as compared to the 1,500 to 5,000 hours of flourescent tubes, reducing maintenance fees dramatically. The lighting systems 12–16 also consume less power than the presently used flourescent systems.

Although several embodiments have been described in detail for purposes of illustration, various modifications may be made without departing from the scope and spirit of the invention. Accordingly, the invention is not to be limited, except as by the appended claims.

What is claimed is:

1. A lighting system utilized in low temperature environments, comprising:

a frame forming a central elongated cavity and having two opposite ends, wherein an interior portion of the frame includes a reflective coating and at least a portion of the frame facing the reflective coating is transparent;

a white light-emitting neon tube having a diameter of six to eight millimeters and positioned within the central elongated cavity adjacent to the reflective coating, the neon tube being interiorly lined with a tri-phosphor blend and containing a neon and argon gas mixture; and a cap attached to each end of the frame so as to hermetically seal the frame, the caps including connectors which allow electrical connection between the neon tube and a power supply.

2. The system of claim 1, wherein the neon and argon gas mixture within the neon tube comprises 85%–95% neon and 5%–15% argon.

3. The system of claim 1, wherein the neon tube comprises multiple neon tubes positioned substantially parallel to one another and having different angles of orientation relative to a longitudinal axis of the frame.

4. The system of claim 1, wherein the frame includes a clip to which the neon tube is attached.

5. The system of claim 1, wherein the power supply converts alternating current voltage to a lower direct current voltage.

6. The system of claim 5, wherein the power supply converts 110 to 240 volts alternating current into 12 to 24 volts direct current.

7. The system of claim 5, including a high-voltage transformer electrically interconnected between the power supply and the neon tube, wherein the transformer converts the low direct voltage from the power supply into a high voltage for lighting the neon tube.

8. The system of claim 7, wherein the transformer converts the 12 to 24 volts direct current supplied from the power supply to at least 800 volts.

9. The system of claim 7, wherein the transformer is positioned within the elongated central cavity of the frame.

10. The system of claim 1, wherein the cap includes an electrical connector capable of mating with a cap electrical connector of a second frame.

11. The system of claim 1, wherein the cap includes a protuberance extending from the end thereof and configured to slidably fit within a channel of a track positioned perpendicular to the frame.

12. The system of claim 11, wherein the protuberance includes electrodes which contact electrodes within the track when the protuberance is fitted into the channel of the track in order to supply power to the neon tube.

13. The system of claim 1, wherein the frame is mounted coplanar to a refrigeration unit shelf with brackets removably attached to the shelf.

14. The system of claim 1, wherein the frame is positioned a predetermined distance from and perpendicular to a refrigeration unit shelf by mounting the frame to a refrigeration unit mullion which contains the power supply.

15. A lighting system utilized in low temperature environments, comprising:

a frame forming a central elongated cavity and having two opposite ends, wherein an interior portion of the frame includes a reflective coating and at least a portion of the frame facing the reflective coating is transparent;

multiple white light-emitting neon tubes each having a diameter of six to eight millimeters, the neon tubes positioned within the central elongated cavity adjacent to the reflective coating and substantially parallel to one another, the neon tubes having different angles of orientation relative to a longitudinal axis of the frame, each neon tube being interiorly lined with a tri-phosphor blend and containing a gas mixture comprising 85%–95% neon and 5%–15% argon;

a cap attached to each end of the frame so as to hermetically seal the frame, the cap including an electrical connector which allows electrical connection between the neon tube and a power supply which converts alternating current voltage to a lower direct current voltage; and a high-voltage transformer electrically interconnected between the power supply and the neon tubes, wherein the transformer converts the low direct current voltage from the power supply into a high voltage for lighting the neon tube.

16. The system of claim 15, wherein the frame includes a clip to which the neon tubes are attached.

17. The system of claim 15, wherein the power supply converts 110 to 240 volts alternating current into 12 to 24 volts direct current.

18. The system of claim 17, wherein the transformer converts the 12 to 24 volts direct current supplied from the power supply to at least 800 volts.

19. The system of claim 15, wherein the transformer is positioned within the elongated central cavity of the frame.

20. The system of claim 15, wherein the cap electrical connector is capable of mating with a cap electrical connector of a second frame.

21. The system of claim 15, wherein the cap includes a protuberance extending from the end thereof and configured to slidably fit within a channel of a track positioned perpendicular to the frame, the protuberance including electrodes which contact electrodes within the track when the protuberance is fitted into the channel of the track in order to supply power to the neon tube.

22. The system of claim 15, wherein the frame is mounted coplanar to a refrigeration unit shelf with brackets removably attached to the shelf.

* * * * *